United States Patent [19]

Trahan et al.

[11] Patent Number: 4,681,195

[45] Date of Patent: Jul. 21, 1987

[54] CARRY BAG CONVERTIBLE TO A MAT

[76] Inventors: Curtis J. Trahan; Mary C. Trahan, both of 1309 Droddy Dr., Port Neches, Tex. 77651; George Spector, 233 Broadway, Rm. 3615, New York, N.Y. 10007

[21] Appl. No.: 839,628

[22] Filed: Mar. 14, 1986

[51] Int. Cl.[4] ..... A45C 9/00; A45C 15/00; A47C 9/10; A47C 17/82

[52] U.S. Cl. ..... 190/2; 190/8; 150/106; 5/414; 5/417; 5/418; 135/95; 135/117; 383/4; 455/344

[58] Field of Search ..... 190/1, 2, 8; 383/4; 5/414, 417–420; 135/95, 117, 902; 455/344, 351; 150/106; 297/118

[56] References Cited

U.S. PATENT DOCUMENTS

| | | | |
|---|---|---|---|
| 1,785,953 | 12/1930 | Hanan | 5/418 |
| 2,190,566 | 2/1940 | Julian | 5/418 |
| 2,264,471 | 12/1941 | Glenn | 5/419 |
| 2,513,013 | 6/1950 | Feldman | 150/106 X |
| 2,531,501 | 11/1950 | Cline | 5/419 X |
| 2,543,597 | 2/1951 | Peery | 135/95 |
| 2,659,905 | 11/1953 | Rochford | 5/414 |
| 2,886,047 | 5/1959 | Healy | 135/95 |
| 3,052,895 | 9/1962 | Lo Vico | 383/4 X |
| 3,489,194 | 1/1970 | Hoover | 190/2 X |
| 4,050,493 | 9/1977 | Cho | 455/344 X |

FOREIGN PATENT DOCUMENTS

| | | | |
|---|---|---|---|
| 141220 | 5/1985 | European Pat. Off. | 297/118 |
| 772321 | 8/1934 | France | 190/2 |
| 2054388 | 2/1981 | United Kingdom | 190/1 |

*Primary Examiner*—William Price
*Assistant Examiner*—Sue A. Weaver

[57] ABSTRACT

A combination carry bag and mat is provided which in an unfolded position can be utilized as a mat to lie upon that has built-in relatively rigid compartments to hold various items and a radio and which in a folded position can be utilized as a carry bag. In a modified form a built-in adjustable and collapsible sun shade protector is for a person when the person lies upon the mat.

3 Claims, 4 Drawing Figures

CARRY BAG CONVERTIBLE TO A MAT

BACKGROUND OF THE INVENTION

The instant invention relates generally to bag/blanket combinations and more specifically it relates to a combination carry bag and mat.

Numerous bag/blanket combinations have been provided in prior art that are adapted to be utilized in one form as a mat and in another form as a handbag. For example, U.S. Pat. Nos. 4,489,815 and 4,516,668 are illustrative of such prior art. While these units may be suitable for the particular purpose to which they address, they would not be as suitable for the purpose of the present invention as heretofore described.

SUMMARY OF THE INVENTION

A principle object of the present invention is to provide a combination carry bag and mat that will overcome the shortcomings of the prior art devices.

Another object is to provide a combination carry bag and mat which in an unfolded position can be utilized as a mat to lie upon having built-in relatively rigid compartments to hold various items and a radio and which in a folded position can be utilized as a carry bag.

An additional object is to provide a combination carry bag and mat that has a built-in adjustable and collapsible sun shade protector for a person when the person lies upon the mat.

A further object is to provide a combination carry bag and mat that is economical in cost to manufacture.

A still further object is to provide a combination carry bag and mat that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
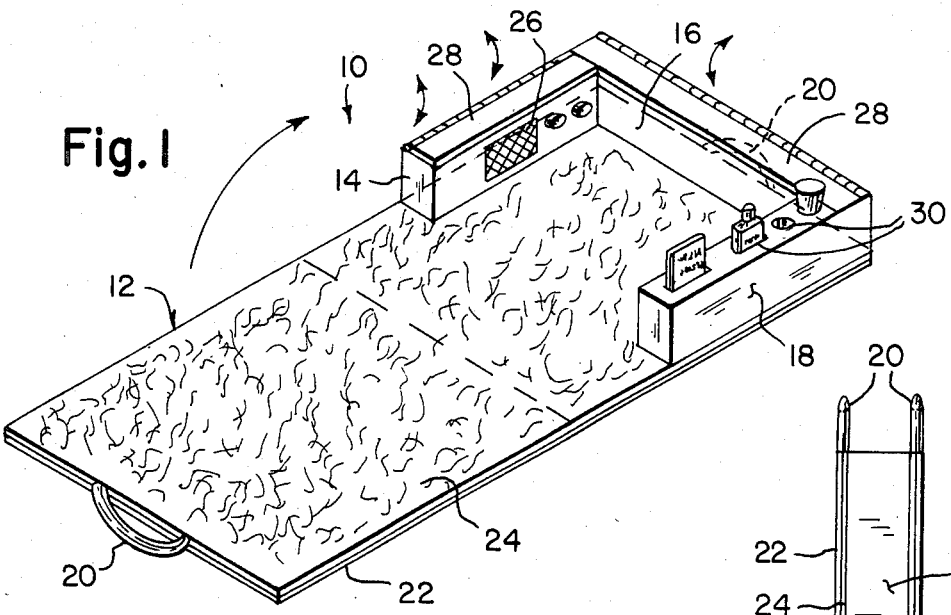
FIG. 1 is a perspective view of the invention in an open position as a mat.
Figure 2:
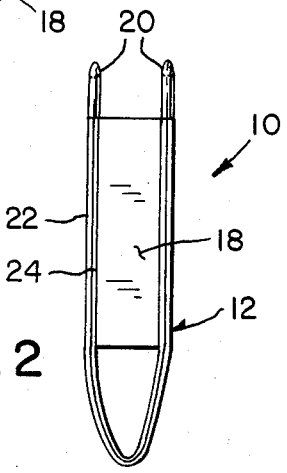
FIG. 2 is a side view thereof in a closed position as a carry bag.

Turning now descriptively to the drawings, in which similar reference characters denote similar elements throughout the several views, FIGS. 1 and 2 illustrates a combination carry bag and mat 10 consisting of a rectangular foldable panel 12, three relatively rigid built-in compartments 14, 16, 18 and a pair of handles 20.

The panel 12 has a waterproof bottom sheet 22 and a water absorbent top sheet 24 of a predetermined length and width. The compartments 14, 16 and 18 are formed in a C-shaped configuration around edges of the panel 12 at front end thereof. The compartments hold various items, such as sunglasses, drink cups, suntan lotion, towel, etc. and including a radio 26. When the panel 12 is in an unfolded flat position, as in FIG. 1, a person (not shown) can lie upon the panel 12 to utilize it as the mat for access to the compartments 14, 16 and 18.

Each of the handles 20 is affixed to a short edge of the panel 12 so that when the panel is in a folded position, as in FIG. 2, a person (not shown) can grip the handles 20 to utilize it as the carry bag. The bottom sheet 22 is fabricated out of plastic material and the top sheet 24 is fabricated out of towel-like material.

Two of the compartments 14 and 16 at the side and front of the panel 12 include hinged lids 28 in which the radio is built into the side hinged lid compartment 14. The other side compartment 18 has a plurality of recesses 30 for holding some of the items.

Figure 3:
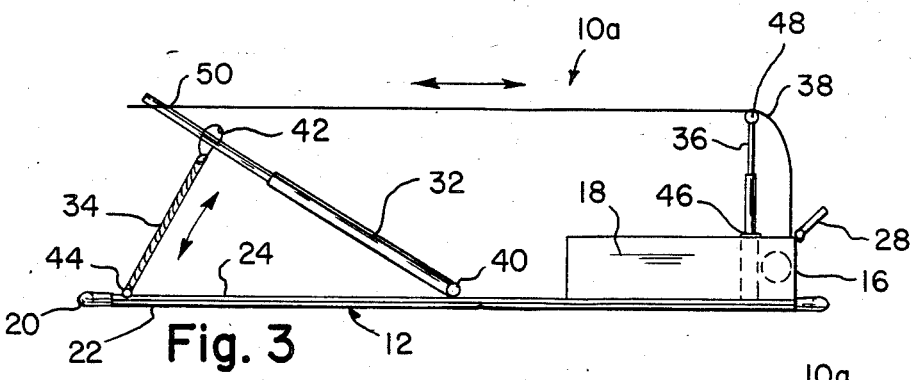
FIG. 3 is a side view of a modification in an open mat position with a built-in adjustable and collapsible sun shade protector.
Figure 4:
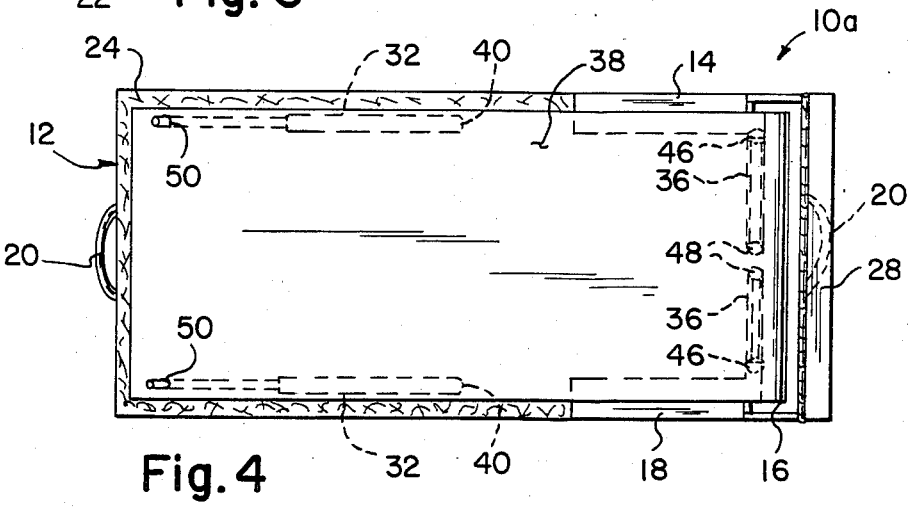
FIG. 4 is a top view thereof.

A modified combination carry bag and mat **10*a* is shown in FIGS. 3 and 4 and consists of a first pair of spaced telescopic rods 32, a pair of spaced elastic cords 34, a second pair of spaced telescopic rods 36 and a window-type shade 38. Each of the first rods 32 is pivotly mounted at 40 to middle of long side of the panel 12. Each of the cords 34 has a hook 42 at distal end and is pivotly mounted at 44 to rear of the panel 12. Each of the second rods 36 is pivotly mounted at 46 to top juncture of one of the side compartments 14, 18 and front compartment 16. Each second rod 36 also has a roller 48 at its distal end. The second rods 36 are shown in dotted in the down position in FIG. 4**.

The window-type shade 38 has a pair of spaced holes 50 at free end thereof and is rotatably mounted within the front compartment 16. When the second rods 36 are positioned in a proper vertical position the shade 38 can be pulled out to extend over the rollers 48 in which distal ends of the first rods 32 can be extended to enter the holes 50. The hooks 42 of the elastic bands 34 can hold the first rods 32 in a proper angular position to counter act pull of the shade 38 thus keeping the shade extended over the panel 12 to block sunlight when the person lies upon the panel.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A combination carry bag and mat comprising:

(a) a rectangular foldable panel having a water proof bottom sheet and a water absorbent top sheet of a predetermined length and width;

(b) three relatively rigid built-in compartments formed in a C-shaped configuration around edges of said panel at front end thereof, said compartments hold various items including a radio so that when said panel is in an unfolded flat position a person can lie upon said panel to utilize it as said mat for access to said compartments; and (c) a pair of handles, each of said handles affixed to a short edge of said panel so that when said panel is in a folded position a person can grip said handles to utilize it as said carry bag, wherein said bottom sheet is fabricated out of plastic material and said top sheet is fabricated out of towel-like material, wherein two of said compartments at side and front of said panel include hinged lids in which said radio is built into said side hinged lid compartment.

2. A combination carry bag and mat as recited in claim 1, further comprising said other side compartment having a plurality of recesses holding some of said items.

3. A combination carry bag and mat as recited in claim 2 further comprising:

(a) a first pair of spaced telescopic rods, each of said first rods pivotaly mounted to middle of long side of said panel;

(b) a pair of spaced elastic cords, each of said cords having a hook at distal end and pivotaly mounted to rear of said panel;

(c) a second pair of spaced telescopic rods, each of said second rods pivotaly mounted to top juncture of one of said side compartments and front compartment, each of said second rods having a roller at distal ends thereof; and (d) a window-type shade having a pair of spaced holes at free end thereof and rotatably mounted within said front compartment so that when said second rods are positioned in a proper vertical position said shade can be pulled out to extend over said rollers in which distal ends of said first rods can be extended to enter said holes and said hooks of said elastic cords can hold said first rods in a proper angular position to counteract pull of said shade thus keeping said shade extended over said panel to block sunlight when said person lies upon said panel.

* * * * *